US010281840B2

(12) United States Patent
Okamoto et al.

(10) Patent No.: US 10,281,840 B2
(45) Date of Patent: May 7, 2019

(54) IMAGE FORMING APPARATUS THAT EXECUTES CLEANING OPERATION ON FIXING SECTION

(71) Applicant: KYOCERA Document Solutions Inc., Osaka (JP)

(72) Inventors: Sueaki Okamoto, Osaka (JP); Eiji Nimura, Osaka (JP); Koji Kuramashi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/964,943

(22) Filed: Apr. 27, 2018

(65) Prior Publication Data

US 2018/0314187 A1 Nov. 1, 2018

(30) Foreign Application Priority Data

Apr. 27, 2017 (JP) ..... 2017-088437

(51) Int. Cl.
*G03G 15/08* (2006.01)

(52) U.S. Cl.
CPC . *G03G 15/0863* (2013.01); *G03G 2221/1627* (2013.01); *G03G 2221/1823* (2013.01)

(58) Field of Classification Search
CPC .... G03G 21/00; G03G 21/04; G03G 15/0863; G03G 15/55; G03G 15/2025; G03G 2221/1627; G03G 2221/1823; G03G 2221/00
USPC ..... 399/71, 24, 12
See application file for complete search history.

(56) References Cited

U.S. PATENT DOCUMENTS

2005/0254837 A1* 11/2005 Takahashi ..... G03G 15/50 399/12
2013/0064583 A1* 3/2013 Yoshida ..... G03G 15/2025 399/327
2016/0041511 A1* 2/2016 Fujii ..... G03G 15/2025 399/327
2018/0239283 A1* 8/2018 Nimura ..... G03G 15/502

FOREIGN PATENT DOCUMENTS

JP 2011-028017 A 2/2011

* cited by examiner

*Primary Examiner* — Walter L Lindsay, Jr.
*Assistant Examiner* — Arlene Heredia
(74) *Attorney, Agent, or Firm* — IP Business Solutions, LLC

(57) ABSTRACT

An image forming apparatus includes a conveyance section, an image forming section, a fixing section, a sheet output tray, a toner container, a suitable product determining section, and a control section. The suitable product determining section determines whether the toner container loaded in an apparatus body is a suitable product. When the suitable product determining section determines that the toner container is not a suitable product, the control section allows the conveyance section, the image forming section, and the fixing section to form, on a sheet, a solid image having a circumferential length of one of rotating bodies of the fixing section or longer, and allows the sheet on which the solid image is formed to pass through a fixing nip, to thereby periodically allow a cleaning operation of removing a contamination adhering to surfaces of rotating bodies of the fixing section to be performed.

12 Claims, 8 Drawing Sheets

IMAGE FORMING APPARATUS THAT EXECUTES CLEANING OPERATION ON FIXING SECTION

INCORPORATION BY REFERENCE

This application claims priority to Japanese Patent Application No. 2017-088437 filed on Apr. 27, 2017, the entire contents of which are incorporated by reference herein.

BACKGROUND

The present disclosure relates to image forming apparatuses and particularly relates to a technique for dealing with an inadequate toner container.

A general image forming apparatus includes: a photosensitive drum as an image carrier; a charging device that electrically charges the photosensitive drum; an exposure device that irradiates the charged surface of the photosensitive drum with laser light based on an original document to form a latent image of the original document on the surface of the photosensitive drum; a developing device that visualizes the latent image with toner; a transfer roller that transfers a toner image formed by the visualization to a sheet; and a fixing section that fixes the transferred toner image on the sheet.

Recently, there is increasing use of inadequate toner containers different from a suitable toner container recommended as a product suitable for an image forming apparatus. Since the inadequate products are different in performance in the suitable product, the use of inadequate toner containers may prevent provision of a sufficient level of performance of the image forming apparatus.

There is a general image forming apparatus that determines whether or not a loaded toner container is a suitable product using a radio-frequency (RF) tag attached to the toner container and a radio-frequency identification (RFID) communication device mounted to an apparatus body of the image forming apparatus. When determining that the loaded toner container is an inadequate product, the image forming apparatus allows its display panel to display a warning message informing the user that an inadequate toner container is loaded, thus prompting the user to use a suitable toner container.

SUMMARY

A technique improved over the above technique is proposed as one aspect of the present disclosure.

An image forming apparatus according to an aspect of the present disclosure includes a conveyance section, an image forming section, a fixing section, a sheet output tray, a toner container, a suitable product determining section, and a control section. The conveyance section conveys a sheet. The image forming section includes an image carrier and forms a toner image on a surface of the image carrier. The fixing section nips, at a fixing nip between two rotating bodies, the sheet having the toner image formed in the image forming section and applies heat and pressure to the nipped sheet to fix the toner image on the sheet. To the sheet output tray, the sheet having the toner image fixed thereon by the fixing section is discharged. The toner container is removably loadable in an apparatus body of the image forming apparatus and contains toner for use in forming the toner image in the image forming section. The suitable product determining section determines whether or not the toner container loaded in the apparatus body is a suitable product.

The control section controls operations of the conveyance section, the image forming section, and the fixing section. The image forming section includes a developing device that supplies to the image carrier the toner supplied from the toner container and forms the toner image on the image carrier. When the suitable product determining section determines that the toner container loaded in the apparatus body is not a suitable product, after every predetermined number of sheets have been subjected to an image forming operation or when every predetermined term has passed, the control section controls the conveyance section, the image forming section, and the fixing section to allow formation of a solid image having a predetermined length on the sheet and to pass the sheet on which the solid image is formed through the fixing nip, to thereby allow a cleaning operation of removing a contamination adhering to surfaces of the rotating bodies of the fixing section to be performed. The predetermined length is set to be equal to or longer than a circumferential length of one of the rotating bodies coming into contact with the solid image.

An image forming apparatus according to another aspect of the present disclosure includes a conveyance section, an image forming section, a fixing section, a sheet output tray, a toner container, a suitable product determining section, a control section, and a cleaning acceptance section. The conveyance section conveys the sheet. The image forming section includes an image carrier and forms a toner image on a surface of the image carrier. The fixing section nips, at a fixing nip between two rotating bodies, the sheet having the toner image formed in the image forming section and applies heat and pressure to the nipped sheet to fix the toner image on the sheet. To the sheet output tray, the sheet having the toner image fixed thereon by the fixing section is discharged. The toner container is removably loadable in an apparatus body of the image forming apparatus and contains toner which is a consumable of the image forming section. The suitable product determining section that determines whether or not the toner container loaded in the apparatus body is a suitable product. The control section controls operations of the conveyance section, the image forming section, and the fixing section. The cleaning acceptance section accepts from a user a cleaning instruction to clean the surfaces of the rotating bodies of the fixing section. The image forming section includes a developing device that supplies to the image carrier the toner supplied from the toner container and forms the toner image on the image carrier. When the cleaning acceptance section accepts from the user the cleaning instruction to clean the surfaces of the rotating bodies of the fixing section, the control section controls the conveyance section, the image forming section, and the fixing section to allow formation of a solid image having a predetermined length on the sheet and to pass the sheet on which the solid image is formed through the fixing nip, to thereby allow a cleaning operation of removing a contamination adhering to surfaces of the rotating bodies of the fixing section to be performed. The predetermined length is set to be equal to or longer than a circumferential length of one of the rotating bodies coming into contact with the solid image. When the suitable product determining section determines that the toner container loaded in the apparatus body is not a suitable product, after every predetermined number of sheets have been subjected to an image forming operation or when every predetermined term has passed, the control section further controls the conveyance section, the image forming section, and the fixing section to allow formation of a predetermined image pattern on the sheet and discharge of the sheet serving as a check sheet to the sheet output tray, thus presenting the check sheet to the user, the check sheet being used for checking surface conditions of the rotating bodies of the fixing section. The predetermined image pattern is an image that enables the user to visually check the surface conditions of the rotating bodies of the fixing section.

DETAILED DESCRIPTION

Figure 1:
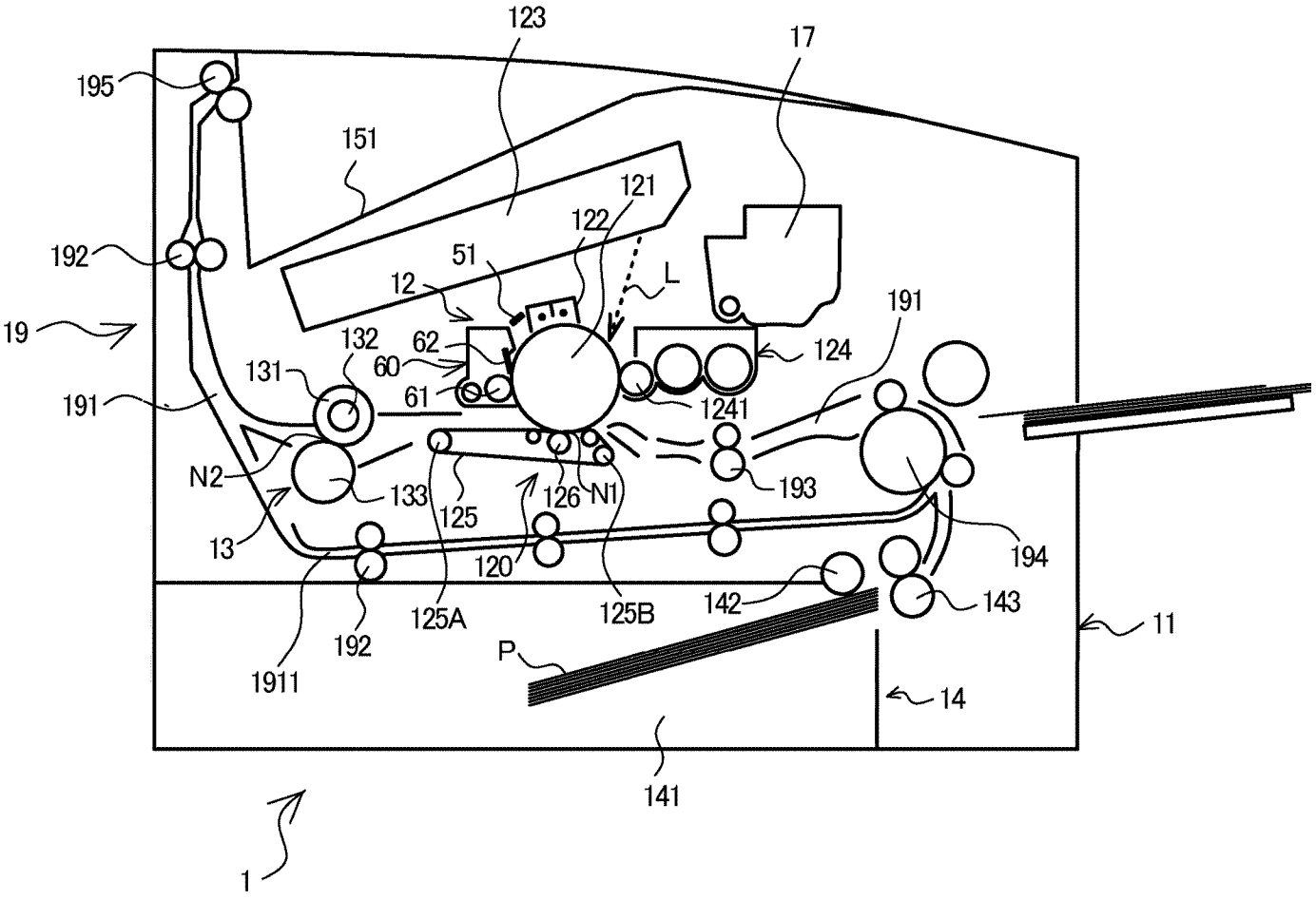
FIG. 1 is a schematic cross-sectional side view showing the structure of an image forming apparatus according to a first embodiment of the present disclosure.

Hereinafter, a description will be given of an image forming apparatus according to an embodiment of the present disclosure with reference to the drawings. FIG. 1 is a schematic cross-sectional side view showing the structure of an image forming apparatus 1 according to a first embodiment of the present disclosure. The image forming apparatus 1 is, for example, a printer and is made up so that an apparatus body 11 thereof includes a sheet feed section 14, an image forming section 12, a toner container 17, a fixing section 13, and a sheet output tray 151. The image forming apparatus 1 further includes a conveyance section 19 that conveys a sheet P (for example, a recording sheet or recording paper) from the sheet feed section 14 via the image forming section 12 and the fixing section 13 to the sheet output tray 151.

The conveyance section 19 includes: a conveyance path 191 connecting between the sheet feed section 14 and the sheet output tray 151; a reverse conveyance path 1911; a plurality of conveyance roller pairs 192 disposed at appropriate locations in the conveyance path 191 and the reverse conveyance path 1911; a registration roller pair 193; a conveyance drum 194, and an output roller pair 195.

The sheet feed section 14 is provided at the bottom of the apparatus body 11 and includes: a sheet feed cassette 141 capable of containing a plurality of sheets P; a first pick-up roller 142 capable of picking up the sheets P contained in the sheet feed cassette 141 sheet by sheet; and a sheet feed roller pair 143 that carries forward the sheet P picked up by the first pick-up roller 142 to the conveyance path 191.

The sheet P fed by the sheet feed roller pair 143 is carried forward via the conveyance drum 194 to the conveyance path 191. The sheet P carried to the conveyance path 191 is fed to the image forming section 12 by the registration roller pair 193.

The image forming section 12 is provided above the sheet feed cassette 141 and includes, a photosensitive drum 121, a charging device 122, an exposure device 123, a developing device 124, a transfer unit 120, a cleaning device 60, and a static elimination device 51.

The photosensitive drum 121 is an image carrier, is formed rotatably about an axis of rotation, and is capable of carrying a toner image on its surface. The charging device 122 has the function of electrically charging the surface of the photosensitive drum 121. The exposure device 123 irradiates the surface of the photosensitive drum 121 with laser light L based on image data sent from an external device (for example, a personal computer) to form a latent image on the surface of the photosensitive drum 121.

The developing device 124 includes a developing roller 1241 and visualizes, with toner, the latent image formed on the surface of the photosensitive drum 121.

The transfer unit 120 is made up by including a conveying belt 125 capable of conveying a sheet P, a drive roller 125A, a driven roller 125B, and a transfer roller 126.

The conveying belt 125 is mounted between the drive roller 125A and the driven roller 125B and driven in engagement against the surface of the photosensitive drum 121 by the drive roller 125A to thus travel in an endless path between both the rollers while synchronizing with the photosensitive drum 121. The transfer roller 126 is disposed at a location where the toner image is to be transferred from the surface of the photosensitive drum 121 to the sheet P and with the conveying belt 125 lying between the photosensitive drum 121 and the transfer roller 126, so that a transfer nip N1 is formed between the transfer roller 126 and the photosensitive drum 121.

The cleaning device 60 includes a cleaning roller 61 and a cleaning blade 62. The cleaning roller 61 and the cleaning blade 62 come into contact with the surface of the photosensitive drum 121 and remove residual toner and deposits on the surface of the photosensitive drum 121 to clean the surface of the photosensitive drum 121.

The static elimination device 51 is a device for removing residual charge on the surface of the photosensitive drum 121 and, for this purpose, irradiates the surface of the photosensitive drum 121 with static eliminating light after the image formation by the image forming section 12.

The toner container 17 is removably loadable in the apparatus body 11, contains toner as a consumable material for the image forming section 12, and supplies the toner to the developing device 124.

The fixing section 13 fixes the toner image on the sheet P by the application of heat and pressure. The fixing section 13 includes a heat roller 131 serving as a fixing roller, a heat lamp 132 built in the heat roller 131 and serving as a heat source, and a pressure roller 133. The heat roller 131 and the pressure roller 133 are opposed to each other. While the sheet P is nipped and conveyed in a fixing nip N2 formed by the heat roller 131 and the pressure roller 133, the unfixed toner image is melted by heat from the heat lamp 132 and fixed on the sheet P by pressure from the heat roller 131 and the pressure roller 133. The heat roller 131 and the pressure roller 133 are examples of the rotating bodies defined in What is claimed is.

The sheet P subjected to the fixing processing is conveyed upward along the conveyance path 191 and discharged via the output roller pair 195 to the sheet output tray 151 provided at the top of the apparatus body 11.

A description will be given of the case where double-sided printing is performed on the image forming apparatus 1. The sheet P having an image formed on one side by the image forming section 12 is nipped by the output roller pair 195, then moved back and conveyed to the reverse conveyance path 1911 by the output roller pair 195, then conveyed to the conveyance path 191 by the conveyance drum 194, and then fed again to the image forming section 12 by the registration roller pair 193. Thus, an image can also be formed on the other side of the sheet P.

Figure 2:
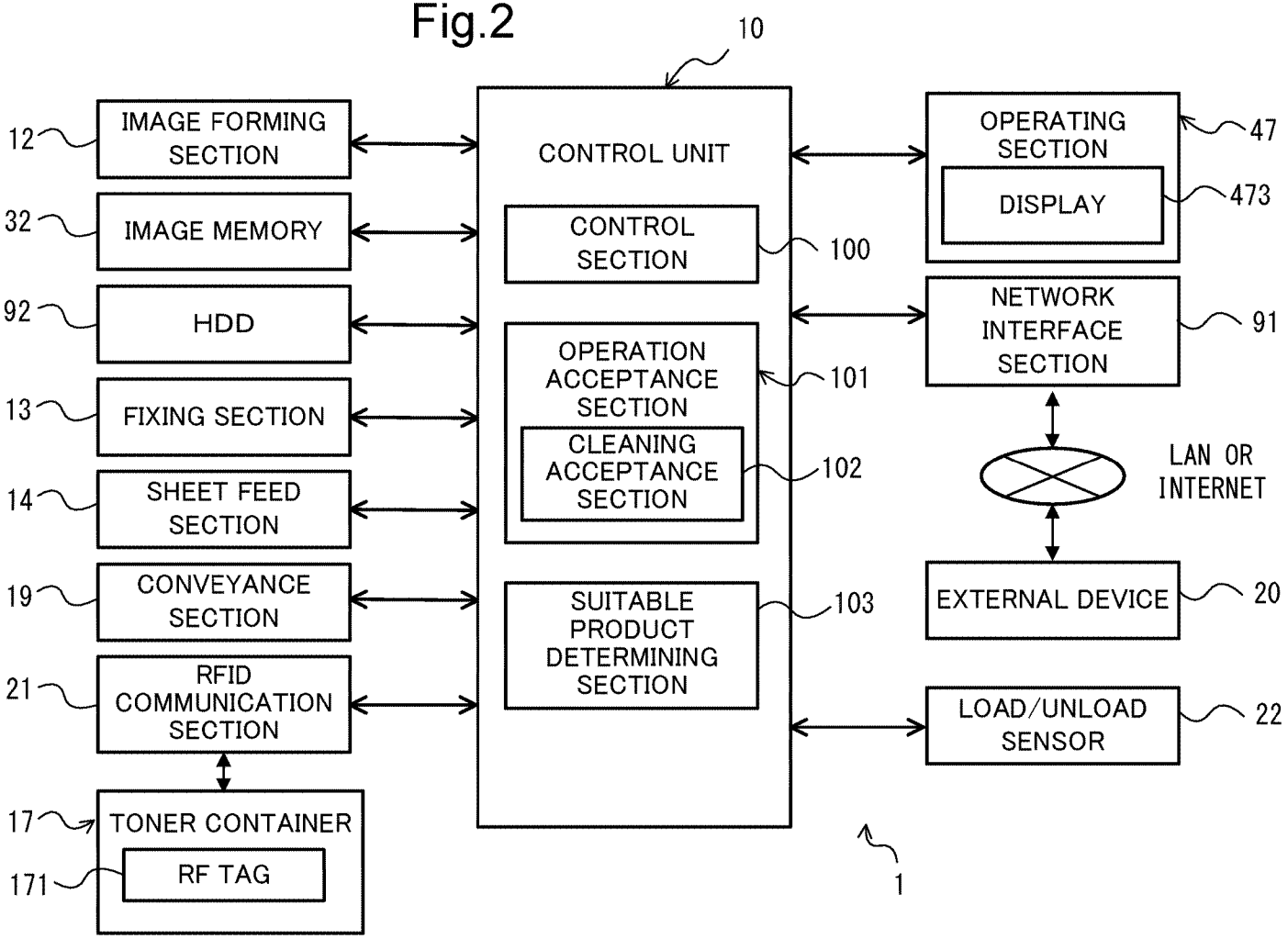
FIG. 2 is a functional block diagram schematically showing an essential internal configuration of the image forming apparatus according to the first embodiment.

FIG. 2 is a functional block diagram schematically showing an essential internal configuration of the image forming apparatus 1. The image forming apparatus 1 is made up by including a control unit 10, the image forming section 12, an image memory 32, a hard disk drive (HDD) 92, the fixing section 13, the sheet feed section 14, the conveyance section 19, an RFID communication section 21, the toner container 17, an operating section 47, a network interface section 91, and a load/unload sensor 22. The same components as those of the image forming apparatus 1 shown in FIG. 1 will be designated by the same references and further explanation thereof will be omitted here.

The image memory 32 provides a region for temporarily storing image data transmitted from an external device 20 (for example, a personal computer) and temporarily saving image data to be printed by the image forming section 12. The HDD 92 is a large storage device capable of storing image data and so on.

The RFID communication section 21 communicates with an RF tag 171 attached to the toner container 17 removably loaded in the apparatus body 11. The RF tag 171 includes a memory for storing product information or the like about the toner container 17. The RFID communication section 21 receives a signal sent from the RF tag 171 to acquire the production information or the like about the toner container 17.

The operating section 47 accepts operator's instructions for various types of operations and processing executable by the image forming apparatus 1, such as an instruction to perform an image forming operation. The operating section 47 includes a display 473 that displays operation guidance and so on for the operator. The display 473 forms a touch panel, through which the operator can touch buttons and keys displayed on the screen to operate the image forming apparatus 1.

The network interface section 91 transfers various data to and from external devices 20, including electronic devices and servers, in a local area or on the Internet. The load/unload sensor 22 detects the loading and unloading of the toner container 17 into and from the apparatus body 11.

The control unit 10 is made up by including a processor, a RAM (random access memory), a ROM (read only memory), and a dedicated hardware circuit. The processor is, for example, a CPU (central processing unit), an ASIC (application specific integrated circuit) or an MPU (micro processing unit). The control unit 10 includes a control section 100, an operation acceptance section 101, and a suitable product determining section 103.

The control unit 10 functions as the control section 100, the operation acceptance section 101, and the suitable product determining section 103 by the operation of the processor in accordance with a control program stored in the HDD 92. However, each of the above-mentioned control section 100 and other sections may not be implemented by the operation of the control unit 10 in accordance with the control program but may be constituted by a hardware circuit. Hereinafter, the same applies to the other embodiments unless otherwise stated.

The control section 100 governs the overall operation control of the image forming apparatus 1. The control section 100 is connected to the image forming section 12, the image memory 32, the HDD 92, the fixing section 13, the sheet feed section 14, the conveyance section 19, the RFID communication section 21, the operating section 47, the network interface section 91, and the load/unload sensor 22 and controls the operations of these components.

The operation acceptance section 101 accepts a user's input of an operation through the operating section 47. In addition, the operation acceptance section 101 includes a cleaning acceptance section 102 that accepts a cleaning instruction to clean surfaces of the rotating bodies (heat roller 131 and pressure roller 133) of the fixing section 13.

When the cleaning acceptance section 102 accepts from the user the cleaning instruction to clean the surfaces of the rotating bodies of the fixing section 13, the control section 100 controls the operations of the conveyance section 19, the image forming section 12, and the fixing section 13 to allow formation of a solid image having a predetermined length on the sheet P, pass the sheet P on which the solid image is formed (i.e., sheet P on which the toner image is formed) through the fixing nip N2, to thereby perform a cleaning operation of removing a contamination adhering to surfaces of the rotating bodies. A tackiness appears on the toner image by heat at the fixing nip N2. The toner adhering to the rotating bodies are collected by the tackiness, thereby removing a contamination for example by toner.

Figure 3:
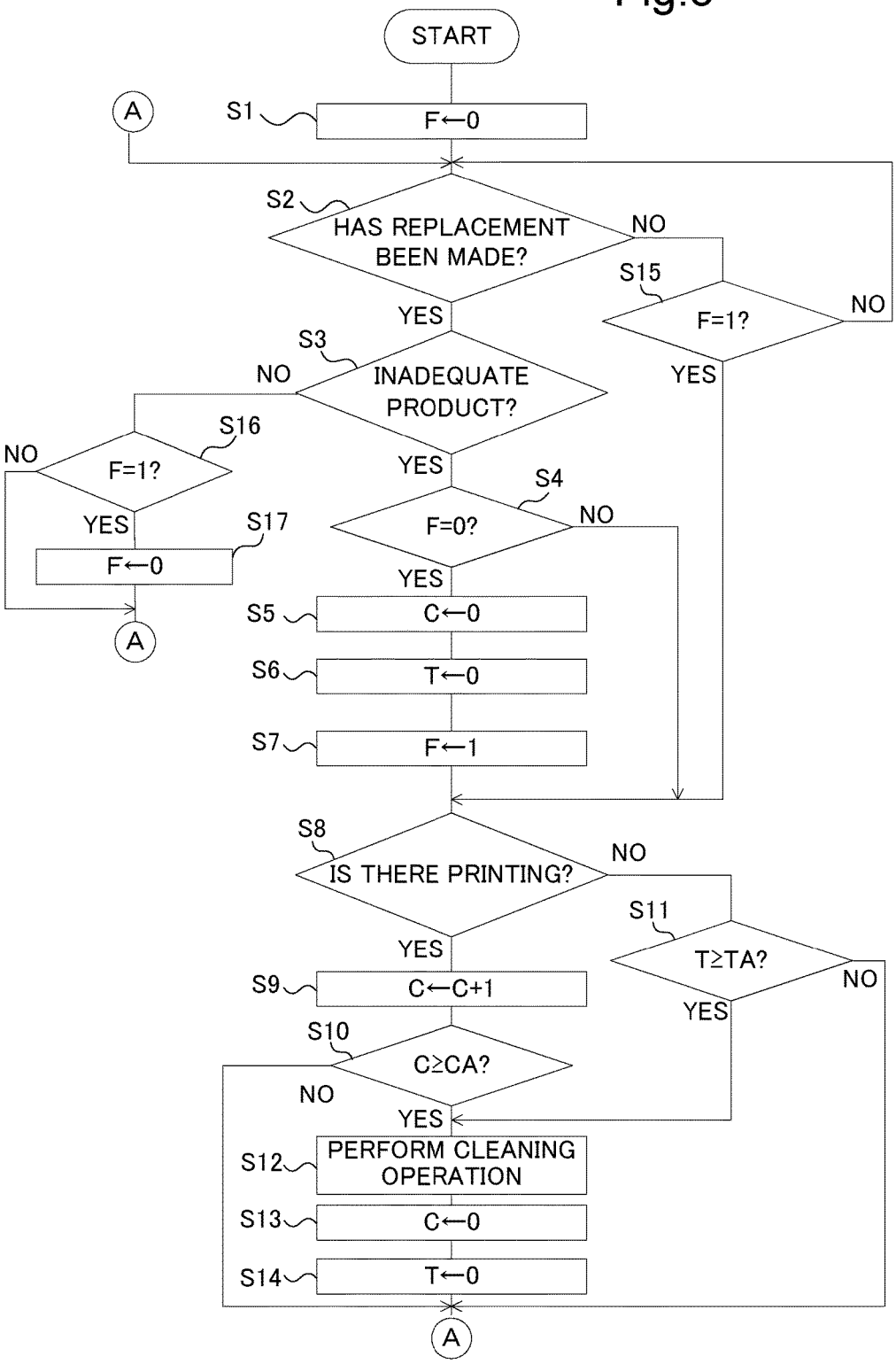
FIG. 3 is a flowchart showing a processing for allowing the image forming apparatus according to the first embodiment to perform a cleaning operation when an inadequate toner container is loaded therein.

Next, a description will be given of processing for allowing the image forming apparatus 1 according to the first embodiment to perform a cleaning operation when the toner container 17 loaded therein is an inadequate product. FIG. 3 is a flowchart showing this processing for allowing the image forming apparatus 1 to perform the cleaning operation.

First, the control section 100 sets, as an initial setting, a flag F indicating whether or not the toner container 17 loaded in the apparatus body 11 is a suitable product to 0 (0: suitable product, 1: inadequate product) (S1). In product shipment, the toner container 17 being a suitable product is loaded, so that the control section 100 sets the flag F to 0.

Subsequently, the control section 100 determines based on information acquired from the load/unload sensor 22 whether or not the toner container 17 has been replaced (S2). When the control section 100 determines that the replacement of the toner container 17 has been made (YES in S2), the suitable product determining section 103 determines, based on information acquired from the RFID communication section 21, whether or not the toner container 17 loaded in the apparatus body 11 is an inadequate product (S3).

When the suitable product determining section 103 determines that the toner container 17 loaded in the apparatus body 11 is an inadequate toner container (YES in S3), the control section 100 determines whether or not the flag F is 0 (S4).

When determining that the flag F is 0 (YES in S4), the control section 100 sets a counter C for counting the number of print copies to 0 (S5) and sets a built-in timer T to 0 (S6). Because the toner container 17 loaded in the apparatus body 11 has been replaced from a suitable product to an inadequate product, the control section 100 further sets the flag F to 1 (S7). Thereafter, the process goes to S8.

On the other hand, when determining that the flag F is not 0 (the flag F is 1) (NO in S4), because this means that the toner container 17 loaded in the apparatus body 11 has been replaced from an inadequate product to an inadequate product and because the flag F has already been set as 1, the control section 100 does not reset the counter C and the timer T to 0 and the process goes to S8.

When in S8 the control section 100 determines that image formation processing is executed and a sheet P is discharged to the sheet output tray 151 (YES in S8), the control section 100 adds 1 to the counter C (S9), and subsequently, determines whether or not the counter C is equal to or more than a predetermined number of sheets CA (for example, 1000 sheets) (S10).

When the control section 100 determines that the counter C is equal to or more than the predetermined number of sheets CA (for example, the number of print copies has reached 1000 sheets ((the predetermined number of sheets CA)) (YES in S10), the control section 100 controls the operations of the conveyance section 19, the image forming section 12, and the fixing section 13 to enable the cleaning operation on the surfaces of the rotating bodies (heat roller 131 and pressure roller 133) of the fixing section 13 (S12).

When in S8 the control section 100 determines that image formation processing is not executed and the sheet P is not discharged to the sheet output tray 151 (NO in S8), the control section 100 further determines whether or not the timer T has passed a predetermined term TA (for example, one week) (S11). When determining that the timer T has passed the predetermined term TA (for example, one week ((the predetermined term TA)) has passed) (YES in S11), the control section 100 performs processing in S12 in order to enable the cleaning operation.

Figure 4:
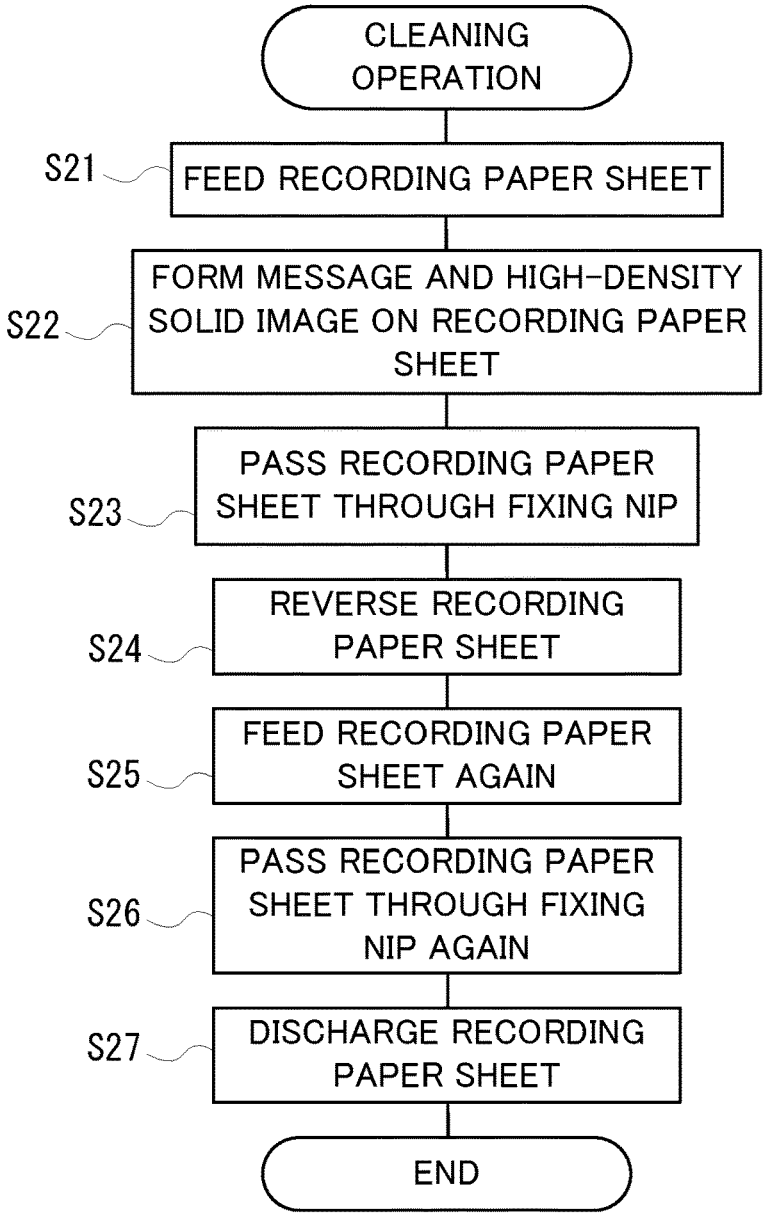
FIG. 4 is a flowchart showing the processing of the cleaning operation performed by a control by a control section.

A description will be given of the cleaning operation performed by the control section 100 according to a flowchart shown in FIG. 4.

The control section 100 controls the operation of a motor and so on that are a driving source of the sheet feed section 14 and the conveyance section 19 to allow the sheet P accommodated in the sheet feed cassette 141 to be fed to the image forming section 12 (S21), and controls the operation of the image forming section 12 to allow: formation of a predetermined message M1 on a front end side in a conveying direction of the sheet P (see FIG. 5); and, on a rear end side in the conveying direction of the sheet, formation of a solid image G1 that has a predetermined length L1 (see FIG. 5) and formed with a high density having a predetermined density (for example, 100%) (see FIG. 5) (S22). The solid image G1 is designed to have high density to increase the adhesive strength.

Thereafter, the sheet P to be used for the cleaning operation is discharged from the sheet output tray 151. The control section 100 allows the image forming section 12 to form, as the predetermined message M1, an image indicating a reason that the sheet P has been discharged from the sheet output tray 151.

Figure 5:
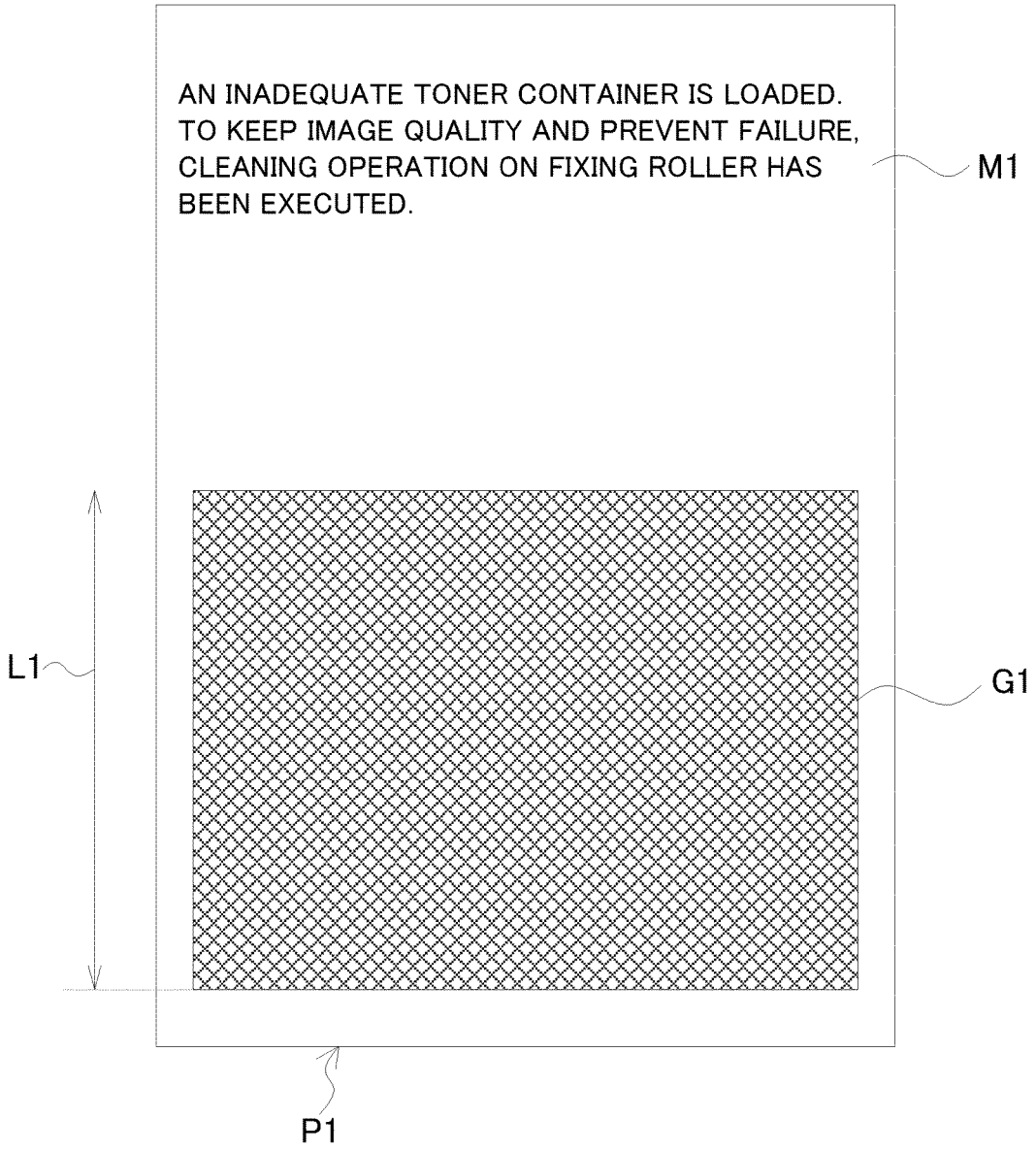
FIG. 5 is a diagram showing an example of a sheet after the cleaning operation is performed on a fixing section.

FIG. 5 is a diagram showing an example of a sheet P1 used for the cleaning operation. For example, the message M1 informs the user of the following: "An inadequate toner container is loaded. To keep image quality and prevent failure, cleaning operation on fixing roller has been executed". The solid image G1 is a solid black image of high density. The length L1 of the solid image G1 is set to be equal to or longer than a circumferential length of the one having a longer circumferential length out of the heat roller 131 and the pressure roller 133. In addition, a width of the solid image G1 is preferably set to be the maximum printable width of the sheet P1.

Subsequently, the control section 100 controls the operations of the conveyance section 19 and the fixing section 13 to pass the sheet P on which a toner image of the message M1 and the solid image G1 is formed through the fixing nip N2 (S23) and to have the toner adhering to the surface of the heat roller 131 that comes into contact with the solid image G1, to thereby remove the toner.

Thereafter, the control section 100 controls the operation of the conveyance section 19 to convey the sheet P to the output roller pair 195, then to reverse the sheet P by the output roller pair 195, then convey to the reverse conveyance path 1911 (S24).

Then, the control section 100 controls the operation of the conveyance section 19 to feed the sheet P (having been conveyed by the conveyance drum 194 to the conveyance path 191, then been reversed) to the image forming section 12 by the registration roller pair 193 (S25). Subsequently, the control section 100 controls the operations of the conveyance section 19 and the fixing section 13 to pass the sheet P through the fixing nip N2 again (S26) and to have the toner adhering to the surface of the pressure roller 133 (here, not the heat roller 131) comes into contact with the solid image G1, to thereby remove the toner. Thereafter, the control section 100 allows the conveyance section 19 to discharge the sheet P to the sheet output tray 151 (S27).

Under the control of the control section 100, a speed where the sheet P is passed through fixing nip N2 is a speed lower than in a normal print operation, and it is preferable that the time when the solid image G1 formed on the sheet P and the surfaces of the heat roller 131 and the pressure roller 133 that come into contact is arranged to be long.

The description was given above taking the case where reversing the sheet P, on which the toner image of the solid image G1 is formed, and passing the both sides of the sheet P through the fixing nip N2. In the case where only one side of the sheet P, not the both sides, is to be passed through the fixing nip N2, the length L1 of the solid image G1 may be set to be equal to or longer than the circumferential length of the heat roller 131 coming into contact with the solid image G1.

In S12 of FIGS. 3 (S21 to S27 in FIG. 4), after performing the cleaning operation on the surfaces of the rotating bodies (heat roller 131 and pressure roller 133) of the fixing section 13, the control section 100 resets the counter C to 0 (S13) and resets the timer T to 0 (S14). Thereafter the process goes back to S2. Also when in S11 the control section 100 determines that the timer T has not passed the predetermined term TA (NO in S11), the process goes back to S2, and the control section 100 determines based on information acquired from the load/unload sensor 22 whether or not the toner container 17 has been replaced (S2).

When in S2 the control section 100 determines that the toner container 17 has not been replaced (NO in S2), the control section 100 determines whether or not the frag F is 1 (S15).

When the control section 100 determines that the flag F is 1 (YES in S15), the toner container 17 loaded in the apparatus body 11 is an inadequate toner container, so that the process goes to S8, and when determining that it is the timing to perform the cleaning operation (YES in S10 or YES in S11), the control section 100 performs the cleaning operation (S12).

On the other hand, when the control section 100 determines that the flag F is not 1 (the flag F is 0) (NO in S15), the toner container 17 loaded in the apparatus body 11 is a suitable product so that the cleaning operation is unnecessary. Therefore, the process goes back to S2 without going to S8.

When in S3 the suitable product determining section 103 determines that the toner container 17 loaded in the apparatus body 11 is not an inadequate product (is a suitable product) (NO in S3), the control section 100 determines whether or not the flag F at that time is 1 (S16).

When the control section 100 determines that the flag F is 1 (YES in S16), the control section 100 sets the flag F to 0 (S17). Thereafter the process goes back to S2. On the other hand, when the control section 100 determines that the flag F is not 1 (the flag F is 0) (NO in S16), it is unnecessary to set the flag F to 0 again, so that the process goes back to S2.

According to the first embodiment, when an inadequate toner container 17 is loaded in the apparatus body 11, after every predetermined number of sheets CA have been subjected to an image forming operation and when every predetermined term TA has passed, the surfaces of the rotating bodies (heat roller 131 and pressure roller 133) of the fixing section 13 are cleaned. Thus, even if the inadequate toner container 17 is used, the toner can be prevented from fixing to the surfaces of the rotating bodies. This provides stable image formation and prevents failure in the image forming apparatus 1.

The control of the fixing temperature in an image forming apparatus is configured according to the thermal properties and charging properties of a suitable toner. Therefore, with the use of an inadequate toner different in these properties from the suitable toner, the difference in thermal properties or charging properties from the suitable toner may cause an offset (a phenomenon where a portion of a toner image formed on a sheet adheres to the fixing roller and is thus stripped off by the fixing roller) in the fixing section. For example, if the amount of heat during melting of the toner is insufficient for an inadequate toner, a so-called cold offset occurs. On the other hand, if the amount of heat during melting of the toner is excessive, a so-called hot offset occurs.

If such an offset continues, the toner (offset toner) adhering to the fixing roller is firmly fixed thereto to decrease the toner releasability (non-tackiness) of the fixing roller, so that toner fixation is further promoted. Furthermore, because the offset toner also comes into contact with the pressure roller opposed to the fixing roller, the offset toner is transferred from the fixing roller to the pressure roller and then firmly fixed to the pressure roller.

If the toner fixation to the fixing roller and the pressure roller progresses, the degree of offset increases, so that the toner fixed to the rollers may fall off and adhere to a sheet carried between the rollers, resulting in the occurrence of an image defect due to contamination with toner. Furthermore, if the toner is fixed to sheet separating claws or a thermistor provided around the fixing roller, the surface of the fixing roller is excessively scraped by the sheet separating claws or the thermistor, so that the durability life of the fixing roller may be significantly shortened.

In addition, once the toner is fixed to the fixing roller, there is the case where even if the toner is returned to a suitable product, the image forming apparatus cannot recover a normal condition, resulting in failure.

As described previously in the above BACKGROUND, there is a general image forming apparatus in which a display panel displays a warning message informing the user that an inadequate toner container is loaded. However, if the user ignores the warning message and continues to use the inadequate toner container, this may cause not only an image defect but also failure in the image forming apparatus itself.

In contrast, in the above first embodiment, toner can be prevented from fixing to the rotating bodies (such as the fixing roller) of the fixing section even if the inadequate toner container is used, which provides stable image formation and prevents failure in the image forming apparatus.

According to the first embodiment, when an inadequate toner container is loaded in the apparatus body 11, the surfaces of the rotating bodies of the fixing section 13 is cleaned after every predetermined number of sheets CA (for example, 1000 sheets) have been subjected to an image forming operation or when every predetermined term TA (for example, one week) has passed. Thus, even if an inadequate toner container is used, the toner can be prevented from fixing to the surfaces of the rotating bodies of the fixing section. This provides stable image formation and prevents failure in the image forming apparatus.

The description was given above for the first embodiment the taking the case where the control section 100 performs both of the counting of the number of print copies and the measurement of the time period, and performs the cleaning operation at the timing "after every predetermined number of sheets CA have been subjected to an image forming operation" or "when every predetermined term TA has passed", whichever comes earlier. In another embodiment, the control section 100 may perform either one of the counting of the number of print copies and the measurement of the time period, and may perform the cleaning operation at either one of the timing "after every predetermined number of sheets CA have been subjected to an image forming operation" or "when every predetermined term TA has passed".

In still another embodiment, the control section 100 may perform the cleaning operation after a power source is turned on. This is because after the turn-on of the power, the temperature of the pressure roller 133 is low and the toner adhering to the rotating bodies tends to transfer on the sheet P, making it easy to remove the toner.

Figure 6:
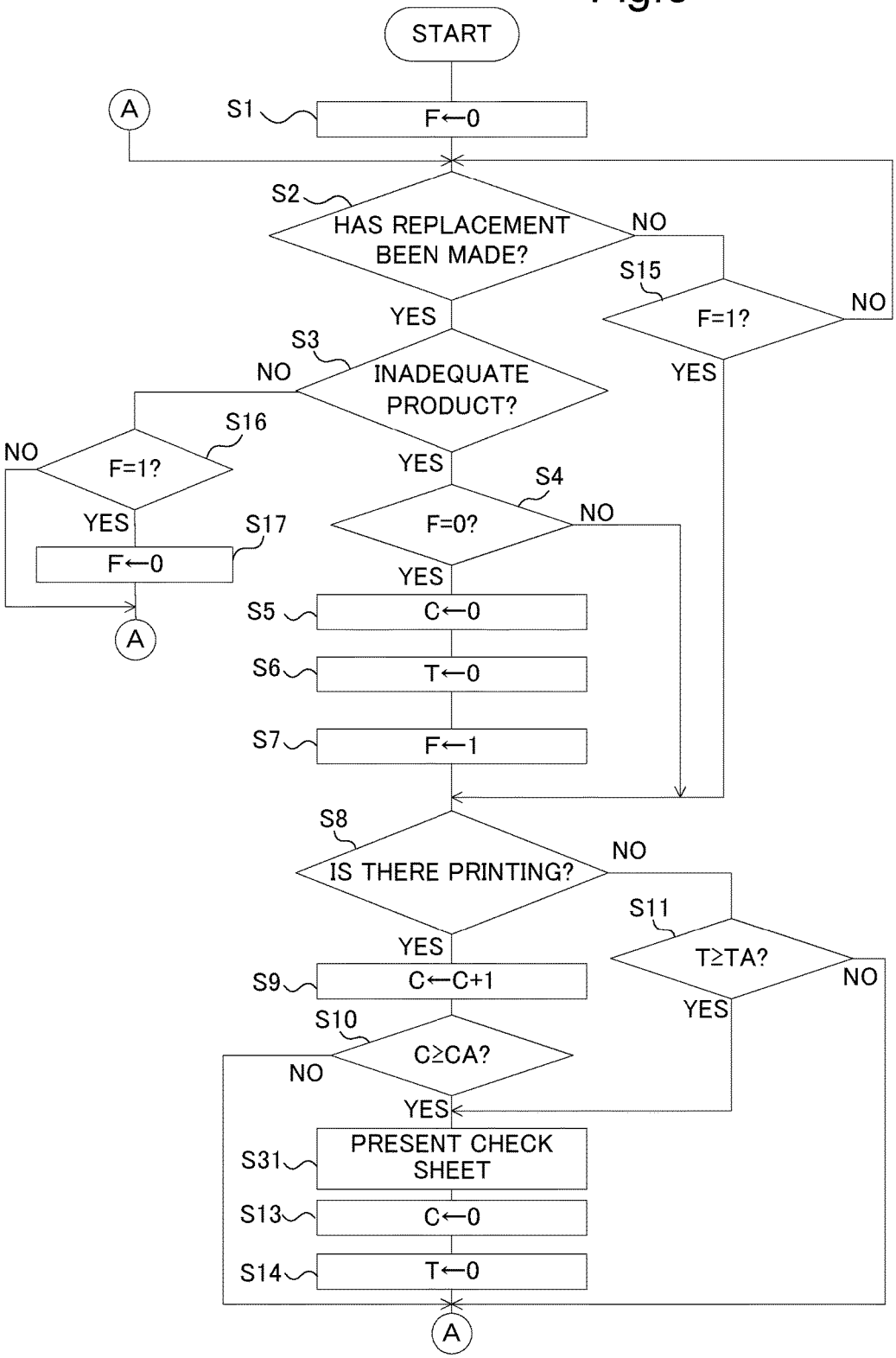
FIG. 6 is a flowchart showing a processing for allowing the image forming apparatus according to a second embodiment to perform the cleaning operation when an inadequate toner container is loaded therein.

Next, a description will be given of processing for allowing the image forming apparatus 1 according to a second embodiment to perform the cleaning operation when the toner container 17 loaded therein is an inadequate product. FIG. 6 is a flowchart showing a processing for allowing the image forming apparatus 1 to perform the cleaning operation. Because the processing in the second embodiment is the same as in the first embodiment except for the portion where S12 in FIG. 3 is replaced by S31, further explanation of the same processing steps as those shown in FIG. 3 will be accordingly omitted.

When in S10 the control section 100 determines that the counter C is equal to or more than the predetermined number of sheets CA (i.e., the number of print copies has been reached to 1000 sheets) (YES in S10), the control section 100 presents to the user a check sheet for checking surface conditions of the rotating bodies of the fixing section 13 (S31).

Also when in S11 the control section 100 determines that the timer T is passed the predetermined term TA (i.e., one week has passed) (YES in S11), the control section 100 performs processing of creating the check sheet (S31).

Figure 7:
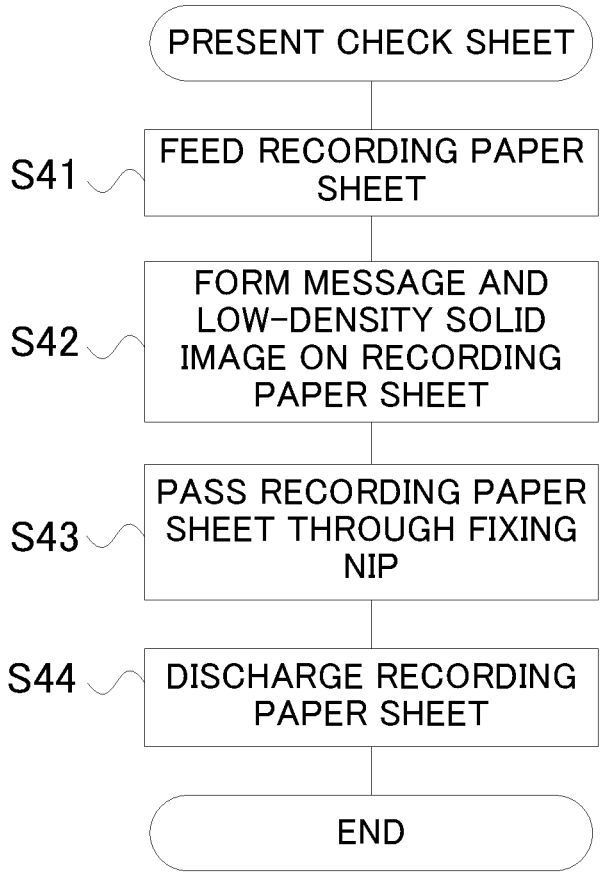
FIG. 7 is a flowchart showing processing of creating a check sheet performed by the control section.

The processing of creating the check sheet performed by the control section 100 is shown in FIG. 7. The control section 100 controls the operations of the sheet feed section 14 and the conveyance section 19 to allow the sheet P accommodated in the sheet feed cassette 141 to be fed to the image forming section 12 (S41), and controls the operation of the image forming section 12 to allow formation of a predetermined second message and a predetermined image pattern on the sheet P.

The predetermined image pattern is an image that enables the user to visually check the surface conditions of the rotating bodies of the fixing section (such as the solid image). On the predetermined second message, a message prompting the user to perform the cleaning operation when the surface conditions of the rotating bodies of the fixing section 13 is unfavorable.

Figure 8:
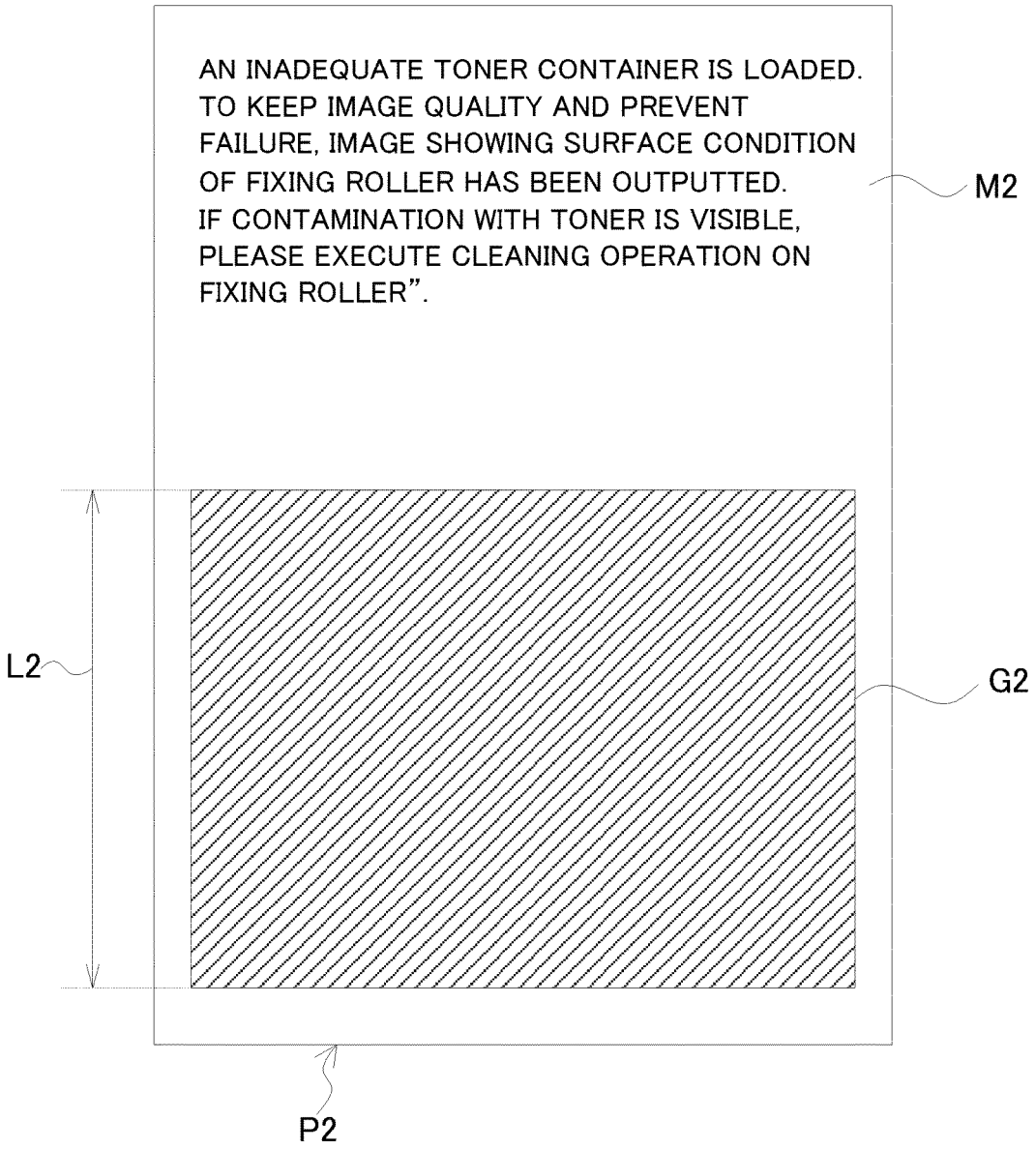
FIG. 8 is a diagram showing an example of the sheet serving as the check sheet.

FIG. 8 is a diagram showing an example of a sheet P2 serving as the check sheet. On the sheet P2 serving as the check sheet, a solid image G2 enables the user to visually check the surface conditions of the rotating bodies (here, the heat roller 131) of the fixing section 13 and a message M2. For example, the message M2 informs the user of the following: "An inadequate toner container is loaded. To keep image quality and prevent failure, image showing surface condition of fixing roller has been outputted. If contamination with toner is visible, please execute cleaning operation on fixing roller".

The solid image G2 is, for example, is a low-density (lower than the solid image G1 formed during the cleaning operation; for example, 50%) solid gray image having a predetermined density, and a length L2 of the solid image G2 is equal to or longer than the circumferential length of the heat roller 131. The solid image G2 is designed to have low density because the solid image G2 is not for removing the toner but for detecting the toner adhering to the surfaces of the rotating bodies of the fixing section 13.

According to the second embodiment, when an inadequate toner container 17 is loaded in the apparatus body 11, the check sheet is presented to the user at the timing "after every predetermined number of sheets CA have been subjected to an image forming operation" or "when every predetermined term TA has passed", whichever comes earlier.

With this arrangement, when an inadequate toner container 17 is loaded in the apparatus body 11, the user is prompted to check the surface conditions of the rotating bodies. This can prevent the situation where the cleaning of the surfaces of the rotating bodies from not being performed for a long period of time even though toner adheres to the surfaces of the rotating bodies. Thus, even if the inadequate toner container 17 is used, the toner can be prevented from fixing to the surfaces of the rotating bodies. This provides stable image formation and prevents failure in the image forming apparatus 1.

According to the second embodiment, when an inadequate toner container is loaded in the apparatus body, the check sheet is presented to the user after every predetermined number of sheets CA (for example, 1000 sheets) have been subjected to an image forming operation or when every predetermined term TA (for example, one week) has passed. On the check sheet, for example, the image that enables the user to visually check the surface conditions of the rotating bodies of the fixing section 13 is formed. With this arrangement, when an inadequate toner container 17 is loaded in the apparatus body 11, the user is prompted to check the surface conditions of the rotating bodies. This can prevent the situation where the cleaning of the surfaces of the rotating bodies from not being performed for a long period of time even though toner adheres to the surfaces of the rotating bodies. Thus, even if the inadequate toner container 17 is used, the toner can be prevented from fixing to the surfaces of the rotating bodies. This provides stable image formation and prevents failure in the image forming apparatus 1.

The description was given above for the first embodiment the taking the case where the control section 100 performs both of the counting of the number of print copies and the measurement of the time period, and presents the check sheet to the user at the timing "after every predetermined number of sheets CA have been subjected to an image forming operation" or "when every predetermined term TA has passed", whichever comes earlier. In another embodiment, the control section 100 may be arranged to perform either one of the counting of the number of print copies and the measurement of the time period, and may present the check sheet to the user at either one of the timing "after every predetermined number of sheets CA have been subjected to an image forming operation" or "when every predetermined term TA has passed".

In addition, the description was given above for the second embodiment taking the case where passing the sheet P through the fixing nip N2 for one time. In still another embodiment, after passing the sheet P through the fixing nip N2 for one time, the control section 100 may control the operation of the conveyance section 19 to reverse the sheet P and feed the sheet P to the image forming section 12 again, then to pass again through the fixing nip N2. In that case, under the control of the control section 100, the length L2 of the solid image G2 is preferably set to be equal to or longer than the circumferential length of the one having the longer circumferential length out of the heat roller 131 and the pressure roller 133. The solid image G2 may be formed on the both sides of the sheet P.

The present disclosure is not limited to the above embodiments and can be modified in various ways. For example, the two rotating bodies forming the fixing section 13 are not limited to the heat roller 131 and the pressure roller 133. One of the rotating bodies may be a fixing belt formed of an endless belt; the other one of the rotating bodies may be a pressure roller. In the case where the fixing belt is provided and passing the both sides of the sheet P, on which the solid image G1 (the solid image G2) is formed, through the fixing nip N2, the length L1 of the solid image G1 (the length L2 of the solid image G2) is preferably set to be equal to or longer than the circumferential length of the one having the longer circumferential length out of the fixing belt and the pressure roller.

Furthermore, in the above embodiment, even if the toner container 17 is replaced from an inadequate product to a suitable product, the toner in the developing device 124 immediately after the replacement is still the inadequate product. The toner in the developing device 124 is gradually replaced from an inadequate toner to a suitable toner. Although the period where a suitable toner is fully replaced from an inadequate toner depends on the size of the developing device 124, a general developing device 124 treating magnetic single-component toner requires printing on about 20000 to about 30000 sheets until the full toner replacement.

Therefore, in still another embodiment, when the control section 100 determines, based on the determination result of the suitable product determining section 103, that the toner container 17 loaded in the apparatus body 11 has been replaced from an inadequate product to a suitable product, the control section 100 may periodically enable the cleaning operation on the rotating bodies of the fixing section 13 until a predetermined time period has passed.

In the case described above, the control section 100 causes the image forming section 12 to form, on the sheet P, a message informing "Inadequate toner has been used in the past. The developing device contains the inadequate toner. To keep image quality and prevent failure, cleaning operation on surface on fixing roller has been executed", instead of the message M1 shown in FIG. 5.

Alternatively, until the predetermined time period has passed, in place of the execution of the cleaning operation, the control section 100 may allow the display 473 to display a message informing the user of a way of coping with the occurrence of an image defect (for example, a message prompting to execute an operation for cleaning the fixing roller) immediately after the replacement with a suitable toner container 17 or periodically.

The predetermined time period is the period where a suitable toner is fully replaced from an inadequate toner. For an example, the predetermined time period is a period of printing on about 20000 to 30000 sheets which it will take to fully replace toner in the developing device 124.

The present disclosure is not limited to the above embodiments and can be modified in various ways. Although the description of the above embodiments is given taking a printer as an example of the image forming apparatus according to the present disclosure, the example is merely illustrative and the image forming apparatus may be any other image forming apparatus, such as a multifunction peripheral having a plurality of functions, for example, a copy function, a print function, a scan function, and a facsimile function, a copier or a facsimile machine.

The structures, configurations, and processing shown in the above embodiments with reference to FIGS. 1 to 8 are merely illustrative of the present disclosure and the present disclosure is not intended to be limited to the above structures, configurations, and processing.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a conveyance section that conveys a sheet;

an image forming section that includes an image carrier and forms a toner image on a surface of the image carrier;

a fixing section that nips, at a fixing nip between two rotating bodies, the sheet having the toner image formed in the image forming section and applies heat and pressure to the nipped sheet to fix the toner image on the sheet;

a sheet output tray to which the sheet having the toner image fixed thereon by the fixing section is discharged;

a toner container that is removably loadable in an apparatus body of the image forming apparatus and contains toner for use in forming the toner image in the image forming section;

a suitable product determining section that determines whether or not the toner container loaded in the apparatus body is a suitable product; and a control section that controls operations of the conveyance section, the image forming section, and the fixing section, wherein the image forming section includes a developing device that supplies to the image carrier the toner supplied from the toner container and forms the toner image on the image carrier, when the suitable product determining section determines that the toner container loaded in the apparatus body is not a suitable product, after every predetermined number of sheets have been subjected to an image forming operation or when every predetermined term has passed, the control section controls the conveyance section, the image forming section, and the fixing section to allow formation of a solid image having a predetermined length on the sheet and to pass the sheet on which the solid image is formed through the fixing nip, to thereby allow a cleaning operation of removing a contamination adhering to surfaces of the rotating bodies of the fixing section to be performed, the predetermined length is set to be equal to or longer than the length of the total circumferential surface of one of the rotating bodies coming into contact with the solid image, and when a determination result of the suitable product determining section changes from a determination that the toner container is an inadequate product to a determination that the toner container is a suitable product, the control section controls operations of the conveyance section, the image forming section, and the fixing section to periodically enable the cleaning operation until a predetermined time period has passed.

2. The image forming apparatus according to claim 1, wherein the control section allows the image forming section to form, on a front end side in a conveying direction of the sheet, a predetermined message indicating a reason that the sheet has been discharged from the sheet output tray and form, on a rear end side in the conveying direction of the sheet, the solid image, and the control section allows the conveyance section to discharge the sheet to the sheet output tray.

3. The image forming apparatus according to claim 1, wherein the control section performs the cleaning operation at a speed lower than in a normal print operation.

4. The image forming apparatus according to claim 1, wherein during the cleaning operation, the control section forms the solid image on the sheet with a predetermined density.

5. The image forming apparatus according to claim 1, wherein the conveyance section is configured to perform double-sided printing of the sheet, during the cleaning operation, the control section passes the sheet through the fixing nip, then reverses the sheet, then passes the sheet through the fixing nip again, and the predetermined length is set to be equal to or longer than a circumferential length of one rotating body having a longer circumferential length out of the two rotating bodies.

6. The image forming apparatus according to claim 1, wherein the predetermined period is a period where a suitable toner is fully replaced from an inadequate toner.

7. An image forming apparatus comprising:

a conveyance section that conveys a sheet;

an image forming section that includes an image carrier and forms a toner image on a surface of the image carrier;

a fixing section that nips, at a fixing nip between two rotating bodies, the sheet having the toner image formed in the image forming section and applies heat and pressure to the nipped sheet to fix the toner image on the sheet;

a sheet output tray to which the sheet having the toner image fixed thereon by the fixing section is discharged;

a toner container that is removably loadable in an apparatus body of the image forming apparatus and contains toner which is a consumable of the image forming section;

a suitable product determining section that determines whether or not the toner container loaded in the apparatus body is a suitable product;

a control section that controls operations of the conveyance section, the image forming section, and the fixing section; and a cleaning acceptance section that accepts from a user a cleaning instruction to clean the surfaces of the rotating bodies of the fixing section;

wherein the image forming section includes a developing device that supplies to the image carrier the toner supplied from the toner container and forms the toner image on the image carrier, when the cleaning acceptance section accepts from the user the cleaning instruction to clean the surfaces of the rotating bodies of the fixing section, the control section controls the conveyance section, the image forming section, and the fixing section to allow formation of a solid image having a predetermined length on the sheet and to pass the sheet on which the solid image is formed through the fixing nip, to thereby allow a cleaning operation of removing a contamination adhering to surfaces of the rotating bodies of the fixing section to be performed, the predetermined length is set to be equal to or longer than the length of the total circumferential surface one of the rotating bodies coming into contact with the solid image, wherein when the suitable product determining section determines that the toner container loaded in the apparatus body is not a suitable product, after every predetermined number of sheets have been subjected to an image forming operation or when every predetermined term has passed, the control section further controls the conveyance section, the image forming section, and the fixing section to allow formation of a predetermined image pattern on the sheet and discharge of the sheet serving as a check sheet to the sheet output tray, thus presenting the check sheet to the user, the check sheet being used for checking surface conditions of the rotating bodies of the fixing section, the predetermined image pattern is an image that enables the user to visually check the surface conditions of the rotating bodies of the fixing section, and when a determination result of the suitable product determining section changes from a determination that the toner container is an inadequate product to a determination that the toner container is a suitable product, the control section controls operations of the conveyance section, the image forming section, and the fixing section to periodically enable the cleaning operation until a predetermined time period has passed.

8. The image forming apparatus according to claim 7, wherein the control section performs the cleaning operation at a speed lower than in a normal print operation.

9. The image forming apparatus according to claim 7, wherein during the cleaning operation, the control section forms the solid image on the sheet with a predetermined density.

10. The image forming apparatus according to claim 7, wherein the conveyance section is configured to perform double-sided printing of the sheet, during the cleaning operation, the control section passes the sheet through the fixing nip, then reverses the sheet, then passes the sheet through the fixing nip again, and the predetermined length is set to be equal to or longer than a circumferential length of one rotating body having a longer circumferential length out of the two rotating bodies.

11. The image forming apparatus according to claim 7, wherein the predetermined image pattern is an image with density lower than that of the solid image.

12. The image forming apparatus according to claim 7, wherein the predetermined period is a period where a suitable toner is fully replaced from an inadequate toner.

* * * * *